US007967650B2

(12) United States Patent
Laabs

(10) Patent No.: US 7,967,650 B2
(45) Date of Patent: Jun. 28, 2011

(54) TENSION SLEEVE SYSTEM FOR ELECTRIC TROLLING MOTORS

(75) Inventor: Edward Anthony Laabs, Rochester Hills, MI (US)

(73) Assignee: Perfect Outdoor Products, LLC, Rochester Hills, MI (US)

( * ) Notice: Subject to any disclaimer, the term of this patent is extended or adjusted under 35 U.S.C. 154(b) by 0 days.

(21) Appl. No.: 12/885,702

(22) Filed: Sep. 20, 2010

(65) Prior Publication Data

US 2011/0076903 A1 Mar. 31, 2011

Related U.S. Application Data

(60) Provisional application No. 61/277,457, filed on Sep. 25, 2009.

(51) Int. Cl.
*B63H 21/17* (2006.01)

(52) U.S. Cl. ..... 440/6

(58) Field of Classification Search ..... 440/6
See application file for complete search history.

(56) References Cited

U.S. PATENT DOCUMENTS

| | | | | |
|---|---|---|---|---|
| 2,804,838 | A | | 9/1957 | Moser |
| 2,829,616 | A | | 4/1958 | O'Brien et al. |
| 2,877,733 | A | | 3/1959 | Harris |
| 2,968,273 | A | | 1/1961 | Corbett et al. |
| 3,002,398 | A | | 10/1961 | Beamer |
| 3,511,208 | A | | 5/1970 | Woodruff |
| 3,602,181 | A | | 8/1971 | Harris |
| 3,606,858 | A | | 9/1971 | Edwards et al. |
| 3,807,345 | A | | 4/1974 | Peterson |
| 3,889,625 | A | | 6/1975 | Roller et al. |
| 4,130,079 | A | | 12/1978 | Rhorer et al. |
| 4,295,385 | A | | 10/1981 | Huttenhow |
| 4,527,983 | A | | 7/1985 | Booth |
| 4,548,586 | A | * | 10/1985 | Phillips, Jr. ..... 440/6 |
| 4,735,166 | A | * | 4/1988 | Dimalanta ..... 114/146 |
| 4,838,818 | A | | 6/1989 | Edwards |
| 5,112,256 | A | | 5/1992 | Clement |
| 5,465,633 | A | | 11/1995 | Bernloehr |
| 5,540,606 | A | | 7/1996 | Strayhorn |
| 6,213,821 | B1 | | 4/2001 | Bernloehr et al. |
| 6,217,453 | B1 | | 4/2001 | Thompson |
| 6,232,685 | B1 | | 5/2001 | Swetish et al. |
| 6,254,441 | B1 | | 7/2001 | Knight et al. |
| 6,325,685 | B1 | | 12/2001 | Knight et al. |
| 6,369,542 | B1 | | 4/2002 | Knight |
| 6,394,859 | B1 | | 5/2002 | Knight et al. |
| 6,431,932 | B1 | | 8/2002 | Pederson |
| 6,468,117 | B1 | | 10/2002 | Healey |
| 6,773,199 | B2 | | 8/2004 | Schott et al. |
| 7,056,166 | B2 | | 6/2006 | Bernloehr |
| 7,118,300 | B2 | | 10/2006 | Bacskay |

* cited by examiner

*Primary Examiner* — Stephen Avila
(74) *Attorney, Agent, or Firm* — Preston Smirman; Smirman IP Law, PLLC

(57) ABSTRACT

A tension sleeve system that is selectively operable to engage a trolling motor system of a watercraft. The tension sleeve system is configured to fit over the area containing the lower portion of the trolling motor's stationary shaft and the middle portion (i.e., the exposed portion) of the swivel shaft, especially in proximity to the middle bearing area between the two shafts. The tension sleeve system is selectively operable to adjust feedback on any cable operated rotational steering system by applying an appropriate amount of tension between the trolling motor's stationary shaft and the swivel shaft, thus controlling the torque and/or energy generated by the propulsion motor and propeller. Clamps or other suitable devices can be used to apply the appropriate amount of tension between the trolling motor's stationary shaft and the swivel shaft by appropriately tightening the tension sleeve members against the external surfaces of the two shafts.

16 Claims, 3 Drawing Sheets

TENSION SLEEVE SYSTEM FOR ELECTRIC TROLLING MOTORS

CROSS-REFERENCE TO RELATED APPLICATION

The instant application claims priority to U.S. Provisional Patent Application Ser. No. 61/277,457, filed on Sep. 25, 2009, the entire specification of which is expressly incorporated herein by reference.

FIELD OF THE INVENTION

The present invention relates generally to trolling motors and in particular to a tension sleeve system for trolling motors.

BACKGROUND OF THE INVENTION

Many fishing and recreational watercraft employ manually operated, remote foot controlled, electric trolling motors for propulsion and positioning of the watercraft. These direct current electric motors develop high thrust and torque/energy during use and therefore must be controlled. Typically, the motor and associated propeller are turned or steered by the operator applying pressure to the remote foot pedal. A cable (or set of cables) is used to provide force from the foot pedal to the motor's steering head and inner mechanism. The cable's force is translated into turning force via the inner mechanism of the motor's steering head. There is a stationary shaft attached to the bottom of the steering head and both parts remain static during any turning of the motor and associated propeller. A second, inner swivel shaft concentrically passes through the larger stationary shaft and has an upper and middle bearing associated therewith that allows rotation of the inner swivel shaft, i.e., relative to the larger stationary shaft. This inner swivel shaft is attached to the motor steering head's inner mechanism on an upper end thereof and to the electric motor and associated propeller on the opposite, lower end thereof.

In order to create the turning operation of the motor, the operator must apply force to the remote control foot pedal which then translates force via the cable to the inner mechanism of the steering head, and then to the inner swivel shaft to achieve the desired direction of the motor and propeller.

Unfortunately, these remote control systems used in conjunction with trolling motors inherently contain free play, or slack, in the steering systems. Thus, during motor operation, this free play becomes unwanted feedback, which requires extra effort from the operator to maintain steering control. This feedback is magnified when the motor is used in wind, waves, current or at high speed settings.

Additionally, this widely used design does not allow for adjustment of effort or tension on the inner swivel shaft. As a result, this allows the motor and associated propeller to rotate excessively, due, in part, to the free play and lack of tension on the steering system. This condition then allows the motor and associated propeller, when energized, to create force and momentum which is then transmitted back to the remote foot pedal. As previously noted, when the force is fed back to the pedal, the operator must respond with additional effort to maintain steering and directional control of the trolling motor and associated propeller. This extra effort is undesirable and creates fatigue and distraction for the operator.

Therefore, it would be advantageous to provide a new and improved trolling motor system, and systems for controlling the operation thereof, that overcomes at least one of the aforementioned problems.

SUMMARY OF THE INVENTION

In accordance with the general teachings of the present invention, there is provided a new and improved tension sleeve system that is selectively operable to engage a trolling motor system, specifically the trolling motor steering control system, of a watercraft.

More specifically, the tension sleeve system is configured to fit over the area containing the lower portion of the trolling motor's stationary shaft and the middle portion (i.e., the exposed portion) of the swivel shaft, especially in proximity to the middle bearing area between the two shafts. The tension sleeve system is selectively operable to adjust any feedback on a rotational steering system by applying an appropriate amount of tension between the trolling motor's stationary shaft and the swivel shaft. For example, clamps or other suitable devices can be used to apply the appropriate amount of tension between the trolling motor's stationary shaft and the swivel shaft by tightening the tension sleeve members against the external surfaces of the two shafts.

In accordance with one embodiment of the present invention, a tension sleeve system is provided for use with a trolling motor system, the trolling motor system having a stationary shaft member and a swivel shaft member rotatable about the stationary shaft member, the stationary shaft member having a diameter greater than a diameter of the swivel shaft member, comprising: a tension sleeve member having a first surface selectively operable to abut a surface of the stationary shaft member and a second surface selectively operable to abut a surface of the swivel shaft member; wherein the tension sleeve member is selectively operable to control the rotational torque of the swivel shaft member relative to the stationary shaft member Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The invention will now be described with reference to the accompanying drawings which show by way of example only one embodiment of an apparatus in accordance with the invention. In the drawings.

The same reference numerals refer to the same parts throughout the various Figures.

DETAILED DESCRIPTION OF THE INVENTION

Figure 1:
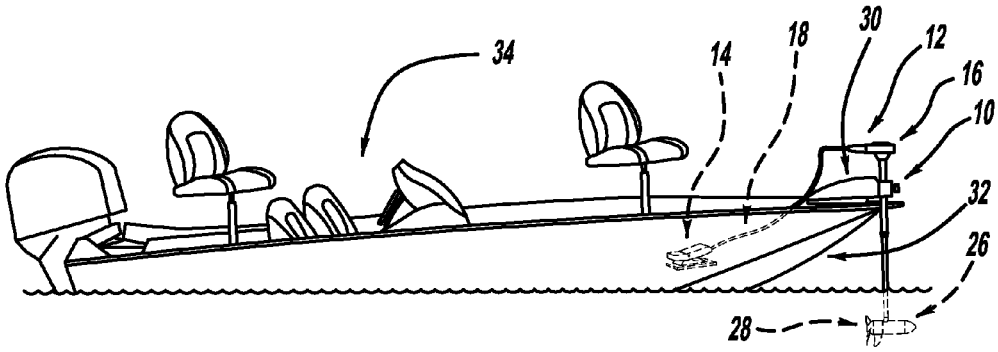
FIG. 1 is an environmental view of a tension sleeve system operably associated with a trolling motor of a watercraft, in accordance with one embodiment of the present invention.

While the present invention will be described in reference to use with a trolling motor of a watercraft, it should be appreciated that the tension sleeve system of the present invention can be used in any number of dampening applications wherein a stationary shaft is associated with a swivel shaft, and wherein it is desired to control the degree and/or ease of rotation of the swivel shaft relative to the stationary shaft.

Referring to the drawings generally, there is shown a tension sleeve system generally at 10.

Figure 2:
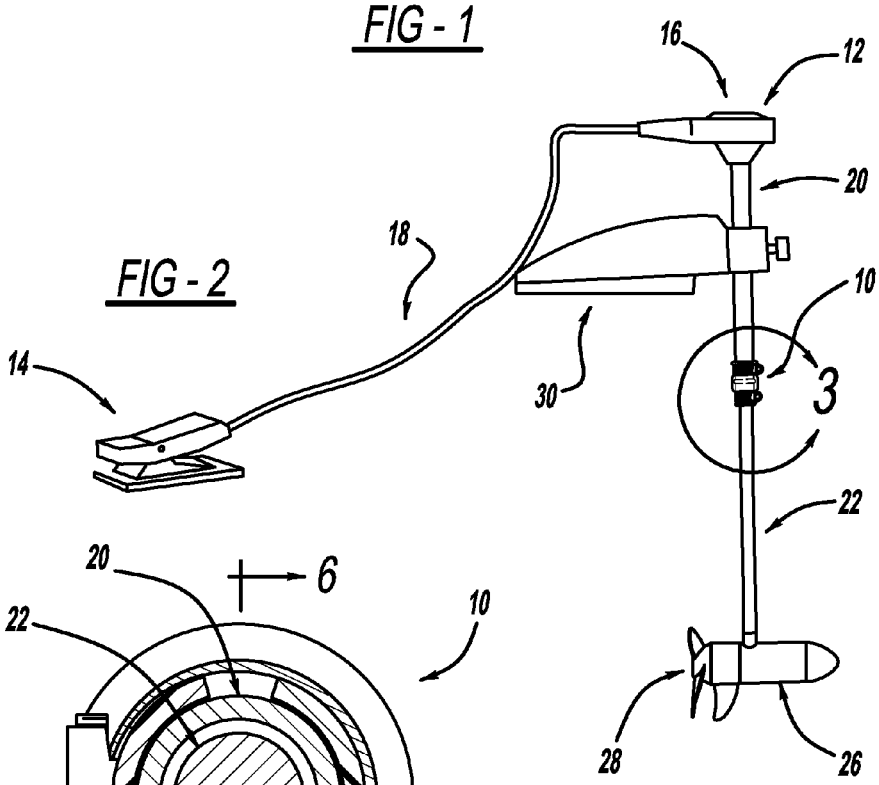
FIG. 2 is an elevational view of a tension sleeve system operably associated with a trolling motor, in accordance with a second embodiment of the present invention.
Figure 4:
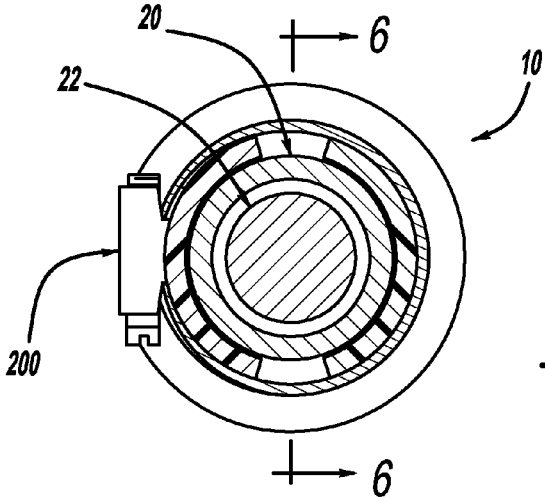
FIG. 4 is a sectional view taken along line 4-4 of FIG. 3, in accordance with a fourth embodiment of the present invention.
Figure 3:
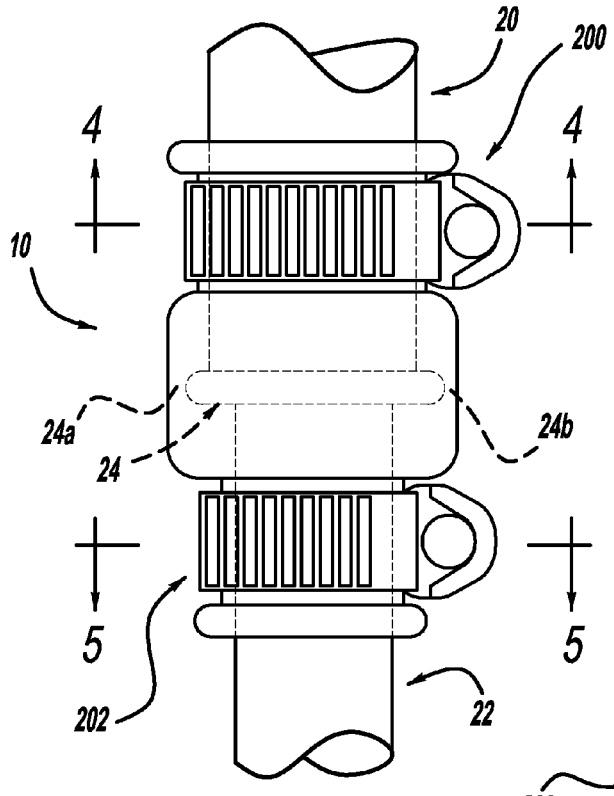
FIG. 3 is a fragmentary front elevational view of a tension sleeve system operably associated with a trolling motor, in accordance with a third embodiment of the present invention.
Figure 5:
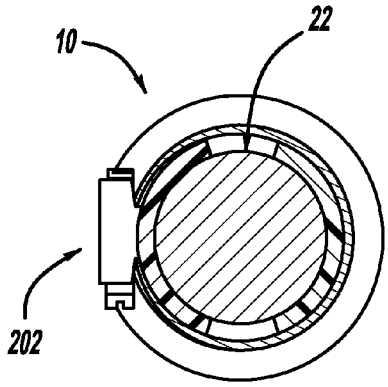
FIG. 5 is a sectional view taken along line 5-5 of FIG. 3, in accordance with a fifth embodiment of the present invention.
Figure 6:
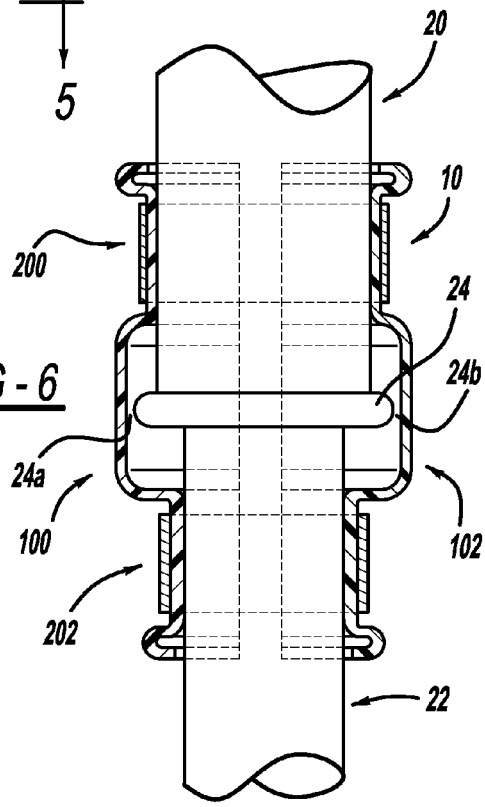
FIG. 6 is a sectional view taken along line 6-6 of FIG. 4, in accordance with a sixth embodiment of the present invention.

Referring specifically to FIGS. 1 and 2, the tension sleeve system 10 is shown mounted to a trolling motor system 12. As previously noted, the trolling motor system 12 typically includes a foot pedal system 14 operably associated with the motor's steering head 16 via a cable system 18. A stationary shaft member 20 is operably associated with the steering head 16 and emanates outwardly therefrom. A second, inner swivel shaft member 22 passes through the larger (i.e., in terms of diameter) stationary shaft member 20 and has an upper (not shown) and a middle swivel bearing system 24 associated therewith that allows rotation of the inner swivel shaft member 22, i.e., relative to the larger stationary shaft member 20. The middle swivel bearing system 24 is typically configured to permit an adequate amount of clearance for the swivel shaft member 22 to pass there through and allow the swivel shaft member 22 to rotate there about. This inner swivel shaft member 22 is attached to the motor steering head 16 on an upper end thereof and to the electric motor 26 and associated propeller 28 on the opposite, lower end thereof. An optional mounting bracket 30 can be used to mount the trolling motor system 12 to the bow 32 (or other desired portion) of the watercraft 34.

Referring specifically to FIGS. 3-8, the tension sleeve system 10 will now be described in detail.

Figure 7:
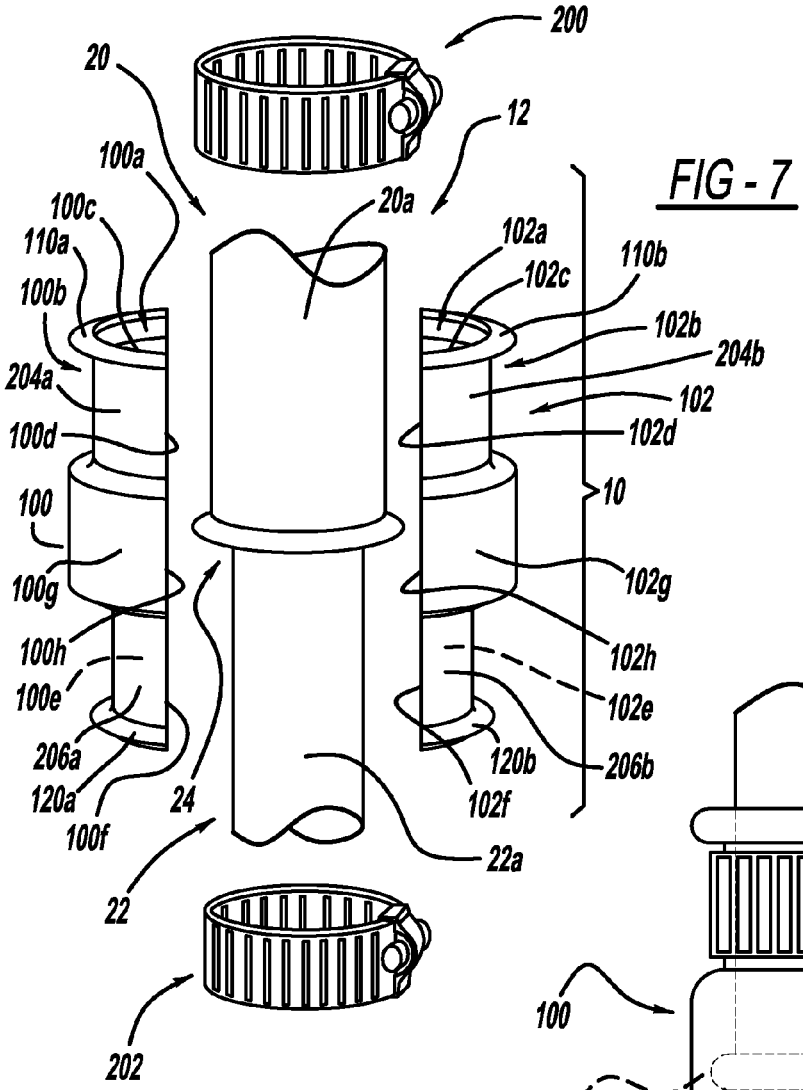
FIG. 7 is an exploded view of a tension sleeve system operably associated with a trolling motor, in accordance with a seventh embodiment of the present invention.
Figure 8:
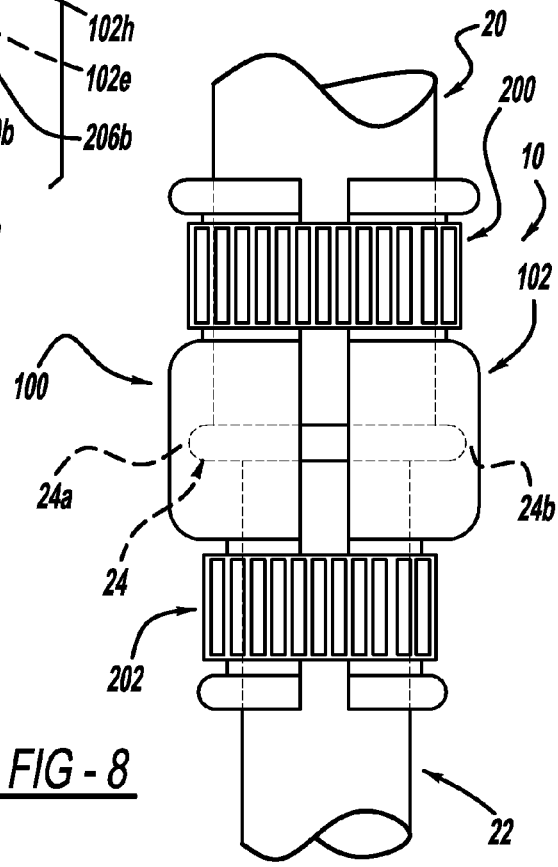
FIG. 8 is a fragmentary side elevational view of a tension sleeve system operably associated with a trolling motor, in accordance with an eighth embodiment of the present invention.

With specific reference to FIG. 7, the tension sleeve system 10 includes a first member 100 and a substantially identical second member 102. Each of the tension sleeve members 100, 102, respectively, include a substantially semi-circular or otherwise curved configuration including an inner surface 100*a*, 102*a*, respectively, and an outer surface 100*b*, 102*b*, respectively. Each of the tension sleeve members 100, 102, respectively, is configured to generally correspond to the curvature of the outer surfaces 20*a*, 22*a*, respectively, of the stationary shaft member 20 and the swivel shaft member 22.

Accordingly, each of the tension sleeve members 100, 102, respectively, are provided with first portions 100*c*, 102*c*, respectively, that generally correspond to the outside diameter and/or curvature of the outer surfaces 20*a* of the stationary shaft member 20. Additionally, each of the first portions 100*c*, 102*c*, respectively, of the tension sleeve members 100, 102, respectively, are configured to envelope only a portion of the circumference of the stationary shaft member 20, i.e., the edge portions 100*d*, 102*d*, respectively, of the tension sleeve members 100, 102, respectively, are not intended to abut against one another when the tension sleeve system 10 is deployed on the trolling motor system 12. This feature is intended to assure that the tension sleeve system 10 can make substantially full surface contact around the stationary shaft member 20.

Additionally, each of the tension sleeve members 100, 102, respectively, are provided with second portions 100*e*, 102*e*, respectively, that generally correspond to the outside diameter and/or curvature of the outer surfaces 22*a* of the swivel shaft member 22. Additionally, each of the second portions 100*e*, 102*e*, respectively, of the tension sleeve members 100, 102, respectively, are configured to envelope only a portion of the circumference of the swivel shaft member 22, i.e., the edge portions 100*f*, 102*f*, respectively, of the tension sleeve members 100, 102, respectively, are not intended to abut against one another when the tension sleeve system 10 is deployed on the trolling motor system 12. This feature is intended to assure that the tension sleeve system 10 can also make substantially full surface contact around the swivel shaft member 22. Also, it should be noted that because the diameter of the swivel shaft member 22 is typically smaller than the diameter of the stationary shaft member 20, the second portion 100*e*, 102*e*, respectively, are positioned inboard of the first portions 100*c*, 102*c*, respectively (e.g., see FIGS. 4 and 5). That is, the circumferences of the second portions 100*e*, 102*e*, respectively, are typically smaller than the circumferences of the first portions 100*c*, 102*c*, respectively. In this respect, because the circumferences (and diameters) of the first and second portions are different, the tension sleeve system 10 can usually only engage the trolling motor system 12 in one correct orientation. In this manner, it is virtually impossible for the operator to incorrectly orient the tension sleeve system 10 to trolling motor system 12.

Furthermore, each of the tension sleeve members 100, 102, respectively, is provided with a third portion 100*g*, 102*g*, respectively, that generally provide clearance to the curvature of the middle swivel bearing system 24 at the interface between the stationary shaft member 20 and the swivel shaft member 22. Additionally, each of the third portions 100*g*, 102*g*, respectively, of the tension sleeve members 100, 102, respectively, are configured to envelope only a portion of the circumference of the middle swivel bearing system 24, i.e., the edge portions 100*h*, 102*h*, respectively, of the tension sleeve members 100, 102, respectively, are not intended to abut against one another when the tension sleeve system 10 is deployed on the trolling motor system 12. However, in this case, it is intended that the tension sleeve system 10 does not contact the middle swivel bearing system 24 (e.g., see FIGS. 6 and 8), but rather provides an adequate amount of clearance 24*a*, 24*b*, respectively, so as to allow the swivel shaft member 22 to freely rotate about the stationary shaft member 20, albeit subject to the control of the tension sleeve system 10. Accordingly, the third portions 100*g*, 102*g*, respectively, have circumferences greater than either of the circumference of the first or second portions, 100*c*, 102*c*, 100*e*, 102*e*, respectively.

In order to secure the tension sleeve members 100, 102, respectively, to the stationary shaft member 20 and the swivel shaft member 22, it is necessary to use clamping members 200, 202, respectively. Flange portions 110*a*, 110*b*, 120*a*, 120*b*, respectively, prevent clamping members 200, 202, respectively, from working their way up and/or down their respective shaft members. Although the clamping members 200, 202, respectively, are shown as "worm-drive" type clamps, it should be appreciated that any device operable to draw the tension sleeve members 100, 102, respectively, against the external surfaces of the first portions 100*c*, 102*c*, respectively, and the second portions 100*e*, 102*e*, respectively, can be used. By way of a non-limiting example, once the tension sleeve members 100, 102, respectively, are properly positioned about the stationary shaft member 20 and the swivel shaft member 22, clamping member 200 is placed around recessed portion 204*a*, 204*b*, respectively, formed on the first portion 100*c*, 102*c*, respectively, of the tension sleeve members 100, 102, respectively. The clamping member 200 is tightened (e.g., with a screw driver) such that the tension sleeve members 100, 102, respectively, are drawn tightly against the external surface of the stationary shaft member 20. Once this has been accomplished, clamping member 202 is placed around recessed portions 206*a*, 206*b*, respectively, formed on the second portion 100*e*, 102*e*, respectively, of the tension sleeve members 100, 102, respectively. The clamping member 202 is tightened (e.g., with a screw driver) such that the tension sleeve members 100, 102, respectively, are drawn loosely against the external surface of the swivel shaft member 22. Once the desired tightness is achieved with respect to clamping member 202, clamping member 200 can then be fully tightened about stationary shaft member 20 so that clamping member 200 cannot move. Clamping member 202 can then be incrementally adjusted to achieve the final desired tightness about swivel shaft member 22. Typically, the tightness (or torque) of the clamping member 200 will be greater than the tightness (or torque) of the second clamping member 202. As a result, the desired amount of tension between the stationary shaft member 20 and the swivel shaft member 22 can be achieved. In this manner, the degree and/or ease of rotation (e.g., especially the rotational torque and/or energy) of the swivel shaft member 22, relative to the stationary shaft member 20, is reduced or lessened in a controlled and deliberate manner. It should be appreciated that the clamping pressure of clamping member 202 can be later adjusted as needed from time to time and/or as conditions warrant.

Preferably, the assembly process is carried out while the trolling motor system 12 is in the stowed position, as opposed to when it is deployed in the water, for purposes of safety and ease.

By way of a non-limiting example, the tension sleeve members 100, 102, respectively, can be comprised of any number of materials, including but not limited to plastics, especially those that are: (1) well-suited for outdoor use, (2) have good frictional wear properties; and (3) can tolerate prolonged exposure to the elements, such as but not limited to olefins and/or the like.

It should be appreciated that the tension sleeve members 100, 102, respectively, and the clamping members 200, 202, respectively, can be packaged in kit form so that all the required components of the tension sleeve system 10 can be provided in a single convenient form. Additionally, the kits can be assembled to correspond to specific models or families of models of trolling motor systems.

The present invention will prevent unwanted movement and excessive over steer, and thereby reduce the operator's efforts needed to maintain control of the trolling motor. This is especially beneficial during operations such as: holding direction, turning, high power start up or usage in rough and turbulent water.

Furthermore, the present invention allows the operator the ability to adjust the steering effort to best suit the conditions encountered on the water, while minimizing the operator's required physical effort. The present invention can be externally installed on almost all cable, remote foot-controlled, electric trolling motors without any need whatsoever to modify and/or retrofit the motors.

While the invention has been described with reference to an exemplary embodiment, it will be understood by those skilled in the art that various changes can be made and equivalents can be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A tension sleeve system for use with an electric trolling motor system, the trolling motor system having a stationary shaft member and a swivel shaft member concentrically received within the stationary shaft member and rotatable inside the stationary shaft member, the stationary shaft member having a diameter greater than a diameter of the swivel shaft member, comprising:

a tension sleeve member having a first surface selectively operable to abut a surface of the stationary shaft member and a second surface selectively operable to abut a surface of the swivel shaft member;

a first clamping member selectively operable to engage the tension sleeve member about a first recessed portion formed on the tension sleeve member, the first clamping member being tightened to a first tightness; and a second clamping member selectively operable to engage the tension sleeve member about a second recessed portion formed on the tension sleeve member, the second clamping member being adjustably tightened to a second tightness, wherein the first tightness is greater than the second tightness;

wherein the tension sleeve member is selectively operable to control or dampen the rotational torque of the swivel shaft member relative to the stationary shaft member.

2. The invention according to claim 1, wherein the first surface has a circumference greater than a circumference of the second surface.

3. The invention according to claim 1, wherein the tension sleeve member further comprises a first recessed portion and a second recessed portion.

4. The invention according to claim 3, wherein the first recessed portion is positioned in proximity to the stationary shaft member.

5. The invention according to claim 3, wherein the second recessed portion is positioned in proximity to the swivel shaft member.

6. The invention according to claim 1, wherein the tension sleeve member further comprises a third surface positioned in proximity to a bearing operably associated with the swivel shaft member.

7. The invention according to claim 6, wherein the third surface has a circumference greater than a circumference of the first or second surfaces.

8. A tension sleeve system for use with an electric trolling motor system, the trolling motor system having a stationary shaft member and a swivel shaft member concentrically received within the stationary shaft member and rotatable inside the stationary shaft member, the stationary shaft member having a diameter greater than a diameter of the swivel shaft member, comprising:

a first tension sleeve member having a first surface selectively operable to abut a surface of the stationary shaft member and a second surface selectively operable to abut a surface of the swivel shaft member;

a second tension sleeve member having a first surface selectively operable to abut a surface of the stationary shaft member and a second surface selectively operable to abut a surface of the swivel shaft member;

a first clamping member selectively operable to engage the first tension sleeve member and the second tension sleeve member about a first recessed portion formed on the first tension sleeve member and the second tension sleeve member, the first clamping member being tightened to a first tightness; and a second clamping member selectively operable to engage the first tension sleeve member and the second tension sleeve member about a second recessed portion formed on the first tension sleeve member and the second tension sleeve member, the second clamping member being adjustably tightened to a second tightness, wherein the first tightness is greater than the second tightness;

wherein the first tension sleeve member and the second tension sleeve member are selectively operable to control or dampen the rotational torque of the swivel shaft member relative to the stationary shaft member.

9. The invention according to claim 8, wherein the first surface has a circumference greater than a circumference of the second surface.

10. The invention according to claim 8, wherein the first recessed portion is positioned in proximity to the stationary shaft member.

11. The invention according to claim 8, wherein the second recessed portion is positioned in proximity to the swivel shaft member.

12. The invention according to claim 8, wherein the first tension sleeve member and the second tension sleeve member further comprise a third surface positioned in proximity to a bearing operably associated with the swivel shaft member.

13. The invention according to claim 12, wherein the third surface has a circumference greater than a circumference of the first or second surfaces.

14. The invention according to claim 8, wherein the first clamping member is selectively operable to clamp the first tension sleeve member and the second tension sleeve member about the stationary shaft member.

15. The invention according to claim 8, wherein the second clamping member is selectively operable to clamp the first tension sleeve member and the second tension sleeve member about the swivel shaft member.

16. The invention according to claim 8, wherein the first tension sleeve member and the second tension sleeve member are identical.

* * * * *